US006145660A

United States Patent [19]

Chou

[11] Patent Number: 6,145,660

[45] Date of Patent: Nov. 14, 2000

[54] GOLF BAG FOR CARRY INVERTED AND NON-INVERTED GOLF CLUBS

[76] Inventor: Joseph M. Chou, 5404 Encinita Ave., Temple City, Calif. 91780

[21] Appl. No.: 09/157,356

[22] Filed: Sep. 19, 1998

[51] Int. Cl.[7] ..... A63B 55/00

[52] U.S. Cl. ..... 206/315.3; 206/315.4; 206/315.6

[58] Field of Search ..... 206/315.2, 315.3, 206/315.6, 315.4

[56] References Cited

U.S. PATENT DOCUMENTS

| | | | |
|---|---|---|---|
| 2,435,893 | 2/1948 | Mall | 206/315.2 |
| 2,520,226 | 8/1950 | Smith | 280/DIG. 6 X |
| 2,590,154 | 3/1952 | Burns | 206/315.2 X |
| 2,597,386 | 5/1952 | Schmid | 280/DIG. 6 X |
| 3,147,022 | 9/1964 | Amendola | 280/DIG. 6 X |
| 3,503,518 | 3/1970 | Black | 206/315.6 X |
| 3,738,677 | 6/1973 | Renock | 280/DIG. 6 X |
| 4,779,725 | 10/1988 | Gerber | 206/315.3 |
| 4,836,565 | 6/1989 | Catalo | 206/315.2 X |
| 5,135,107 | 8/1992 | Ingraham | 206/315.6 |
| 5,168,992 | 12/1992 | Bowdy | 206/315.6 |
| 5,269,411 | 12/1993 | Hong | 206/315.6 X |
| 5,445,267 | 8/1995 | Biafore, Jr. | 206/315.3 |
| 5,725,095 | 3/1998 | Beck et al. | 206/315.8 |

FOREIGN PATENT DOCUMENTS

| | | | |
|---|---|---|---|
| 226654 | 6/1958 | Australia | 206/315.3 |
| 689853 | 4/1953 | United Kingdom | 206/315.3 |

*Primary Examiner*—Sue A. Weaver

*Attorney, Agent, or Firm*—Raymond Y. Chan; David and Raymond

[57] ABSTRACT

A golf bag for carrying inverted and non-inverted golf clubs includes a rectangular interior case, an exterior cover bag for enclosing the interior case, and means for carrying the golf bag. The interior case includes a base case, a top panel and a rectangular supporting shell affixed between the base case and the top panel to form a rectangular case. A front side of the base case provides seven inclined slots aligned side by side in predetermined angles of 20°, 24°, 28°, 32°, 36°, 40°, 44° respectively. Each of the inclined slots extends inwardly to form an individual and isolated head cavity. Therefore, the seven club heads of a whole set of irons are adapted to respectively insert into the corresponding head cavities through the slots. The top panel has a plurality of openings aligned thereon for respectively inserting the shafts of wood clubs therethrough. Eight holders are provided on a front side of the top panel and respectively aligned right above the slots of the base case. Therefore, an upper grip of the iron club, which club head is received in the corresponding head cavity, so that the weight of the whole set of golf clubs stored in the golf bag is balanced for steady shouldering and preventing unexpected turning over of the golf bag.

18 Claims, 6 Drawing Sheets

GOLF BAG FOR CARRY INVERTED AND NON-INVERTED GOLF CLUBS

FIELD OF THE PRESENT INVENTION

The present invention relates to golf bags, and more particularly to a golf bag which not only enables the golf clubs being stored therein and organized in weight balancing manner in order to facilitate travel carrying, but also prevents the golf clubs from impacting with each other when any particular golf club is placed in position or pulled thereout.

BACKGROUND OF THE PRESENT INVENTION

Traditional golf bag, as shown in FIG. 1, comprises a cylindrical and hollow case 11 which top panel 12 has a plurality of openings 13 for the shafts 14 of a plurality of golf clubs 15, including the woods 151 and the irons 152, inserting therethrough, so as to enable the golf players to carry the whole set of golf clubs 15 during travelling and the game.

Every golf club includes an elongated shaft, a grip connected to one end of the shaft for player's gripping and a club head connected to another end of the shaft, wherein the club head is the heaviest part of the golf club for hitting the golf ball by swinging the golf club. As mentioned above, the golf clubs are stored in the golf bag by inserting the shafts into the golf bag while the club heads positioned upwards. In other words, the major weight of all the golf clubs is concentrated on top of the golf bag. The top-heavy condition of the golf bag as shown in FIG. 1 contains the following shortcomings:

1. The golf bag may easily lose balance and turn over when standing on ground.

2. When the golf player shoulders the shoulder strap 16 of the golf bag, the golf bag is carried horizontally. However, the top-heavy golf bag has a tendency to lose balance, so that great attention must be paid to prevent the golf clubs from falling out of the golf bag due to gravity.

3. When the player takes out the irons, especially the putter, which are generally shorter than the woods, from the gold bag, the hard club heads of the irons would frequently impact with the club heads of the woods and cause unexpected damages. Similarly, the club heads of the woods as well as the irons would be hit when inserting an iron club.

4. During travelling the set of golf clubs in the golf bag, it is impossible to prevent the irons from impacting with each other that may cause serious or minor damages to the iron heads.

5. Although the player may easily select the desired wood due to the apparent difference of the length of each wood, the player always finds difficulty to pick the desired iron since all the club heads of the irons are randomly mixed.

6. When the cylindrical golf bag and the golf clubs stored therein are travel in the trunk, it is difficult to hold the laying down golf bag in position and prevent it from rolling in the trunk, that may cause unexpected damages to the golf clubs. The only solution is to install specific device in the trunk to secure the golf bag in position.

SUMMARY OF THE PRESENT INVENTION

It is thus a main object of the present invention to provide a golf bag which not only enables the golf clubs being stored therein and organized in weight balancing manner in order to facilitate travel carrying, but also prevents the golf clubs from impacting with each other when any particular golf club is placed in position or taken out.

A further object of the present invention is to provide a golf bag, wherein all the club heads of the irons are positioned at bottom of the golf bag while the club heads of the woods are extended upwards, so that the total weight of all the golf clubs is balanced to prevent top-heavy condition of the golf bag.

Yet another object of the present invention is to provide a golf bag, wherein each club head of each iron is stored in an individual and isolated cavity to avoid impacting with each other during travelling.

Still another object of the present invention is to provide a golf bag which enables the golf player to smoothly and precisely take out or place in any golf club without impacting with others.

Still another object of the present invention is to provide a golf bag which enables the golf player to organize his or her golf clubs orderly, so that he or she can select the desired golf club easily and rapidly.

Still another object of the present invention is to provide a golf bag which can flatly lay in the trunk while travelling.

Accordingly, in order to accomplish the above objects, the present invention provides a golf bag which comprises a rectangular interior case, an exterior cover bag for enclosing the interior case, and means for carrying the golf bag.

The interior case comprises a base case, a top panel and a rectangular supporting shell affixed between the base case and the top panel to form a rectangular case. A front side of the base case provides a plurality of inclined slots aligned side by side in predetermined angles of 20°, 24°, 28°, 32°, 36°, 40°, 44° respectively. Each of the inclined slots extends inwardly to form an individual and isolated head cavity, wherein the width of each head cavity must be slightly larger than the thickness of each iron head. Therefore, the club heads of the seven irons are adapted to respectively insert into the corresponding head cavities through the slots. The top panel has a plurality of openings aligned thereon for respectively inserting the shafts of wood clubs therethrough. A plurality of holders are provided on a front side of the top panel and respectively aligned right above the slots of the base case. Therefore, an upper grip of the iron club, which club head is received in the corresponding head cavity, is adapted to be firmly secured by the respective holder.

Thereby, the major weight of all the club heads of the irons are loaded at bottom of the golf bag while the club heads of the woods are positioned on top of the golf bag, so that the weight of the whole set of golf clubs stored in the golf bag is balanced for steady shouldering and preventing unexpected turning over of the golf bag.

DETAILED DESCRIPTION OF THE PREFERRED EMBODIMENT

Figure 1:
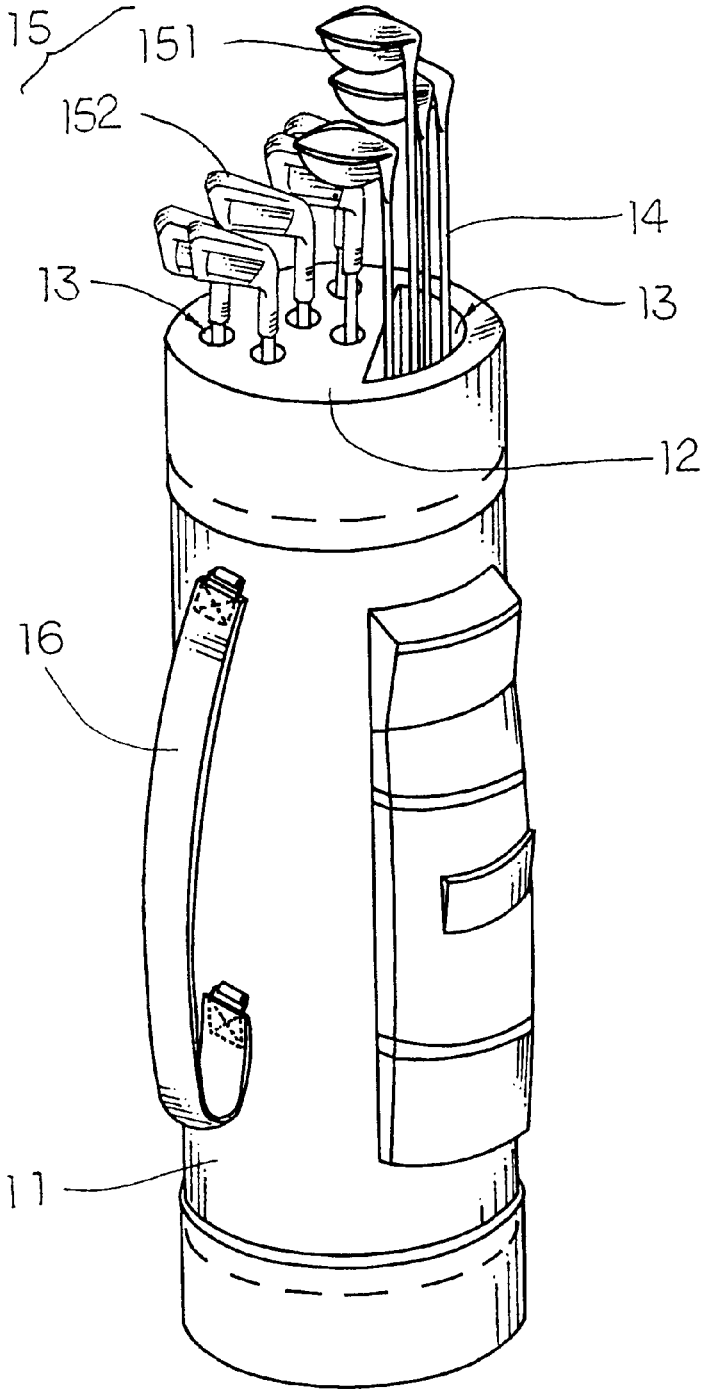
PRIOR ART FIG 1
FIG. 1 is a perspective view of a conventional golf bag.
Figure 2:
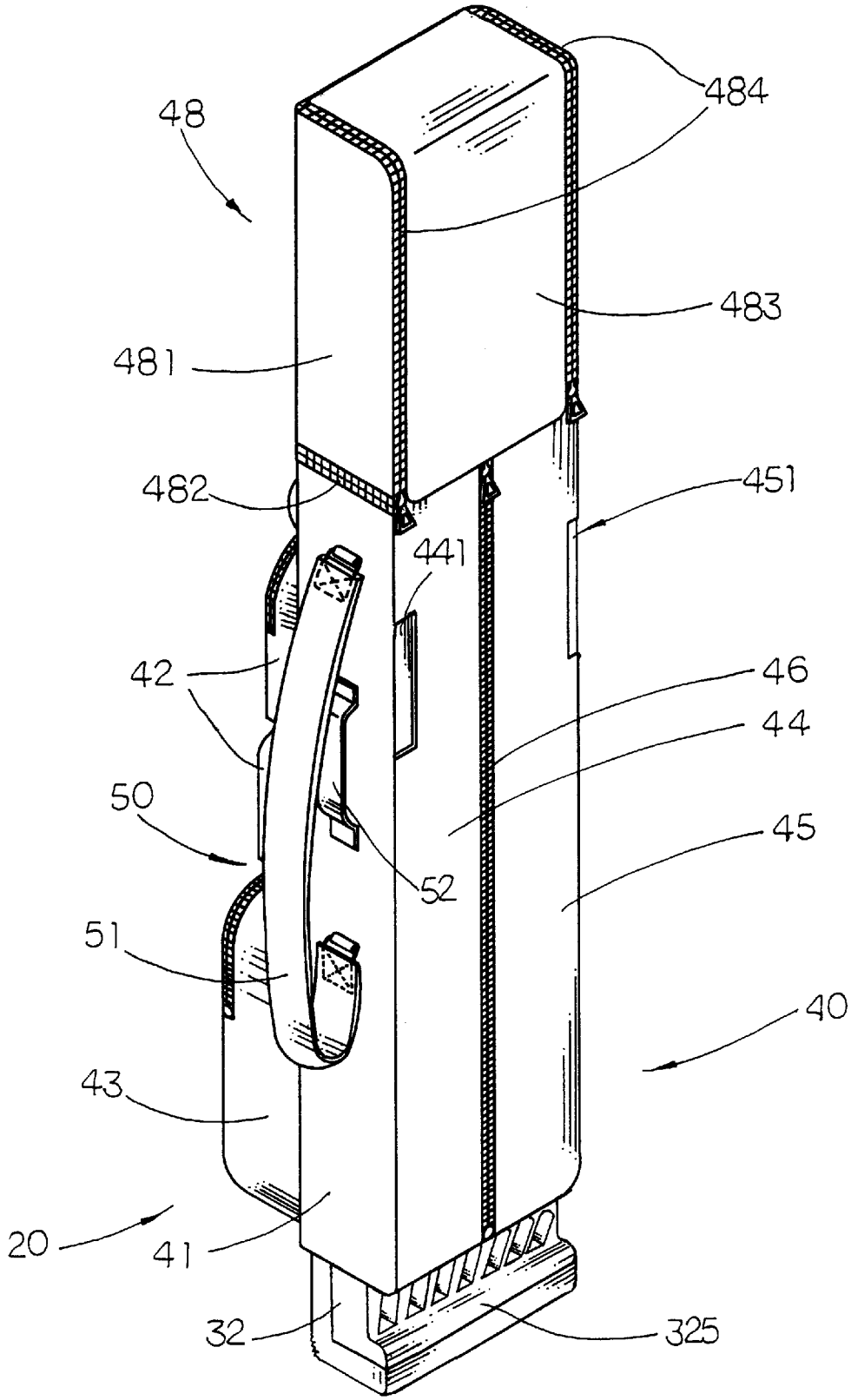
FIG. 2 is a perspective view of a golf bag according to a preferred embodiment of the present invention.
Figure 3:
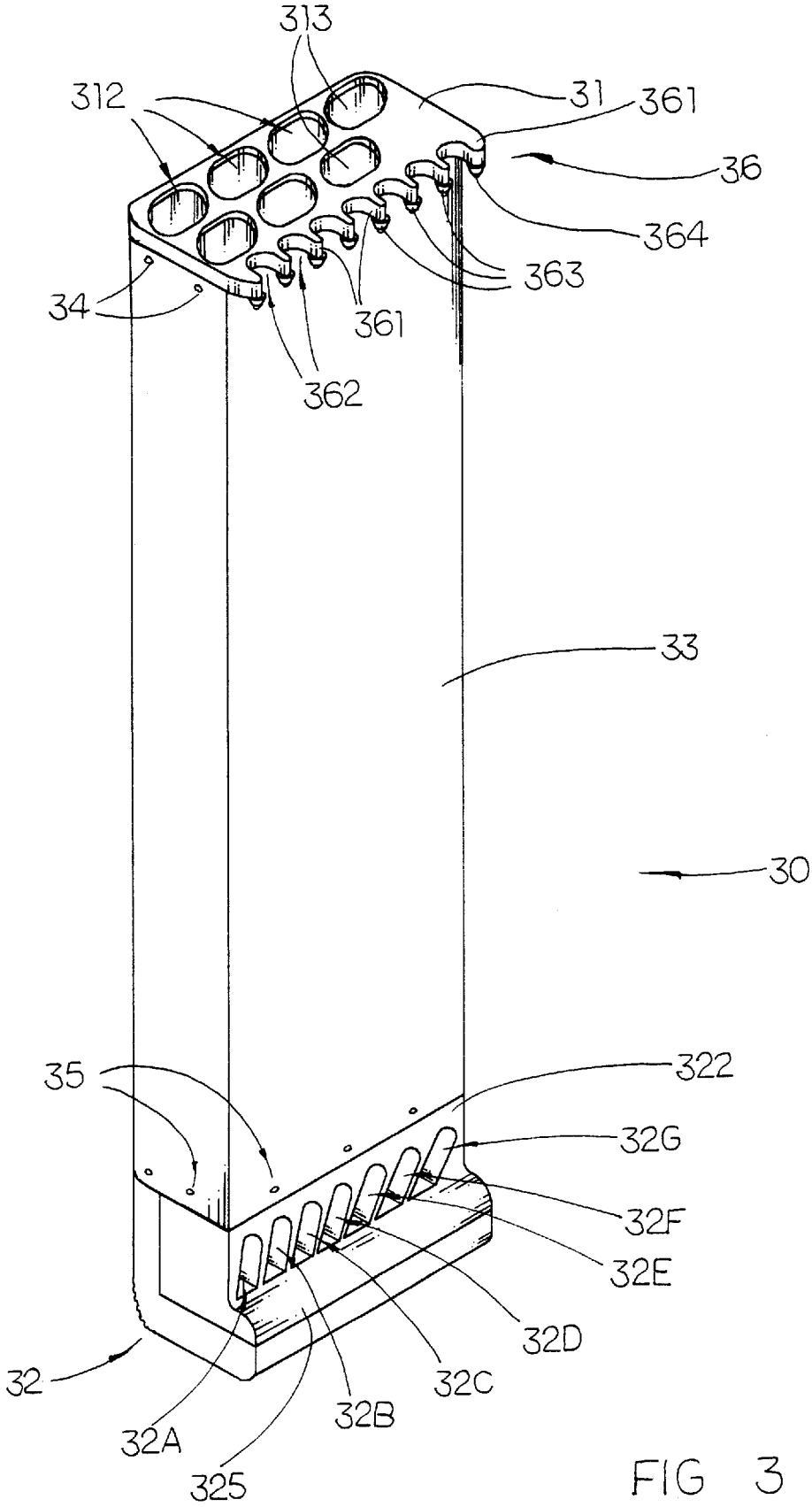
FIG. 3 is a perspective view of the interior case of the golf bag according to the above preferred embodiment of the present invention.

Referring to FIGS. 2 to 6, a golf bag 20 according to a preferred embodiment of the present invention is illustrated, which comprises a rectangular interior case 30 (as shown in FIG. 3), an exterior cover bag 40 for enclosing the interior case 30, and means 50 for carrying the golf bag 20 (as shown in FIG. 2).

Figure 4:
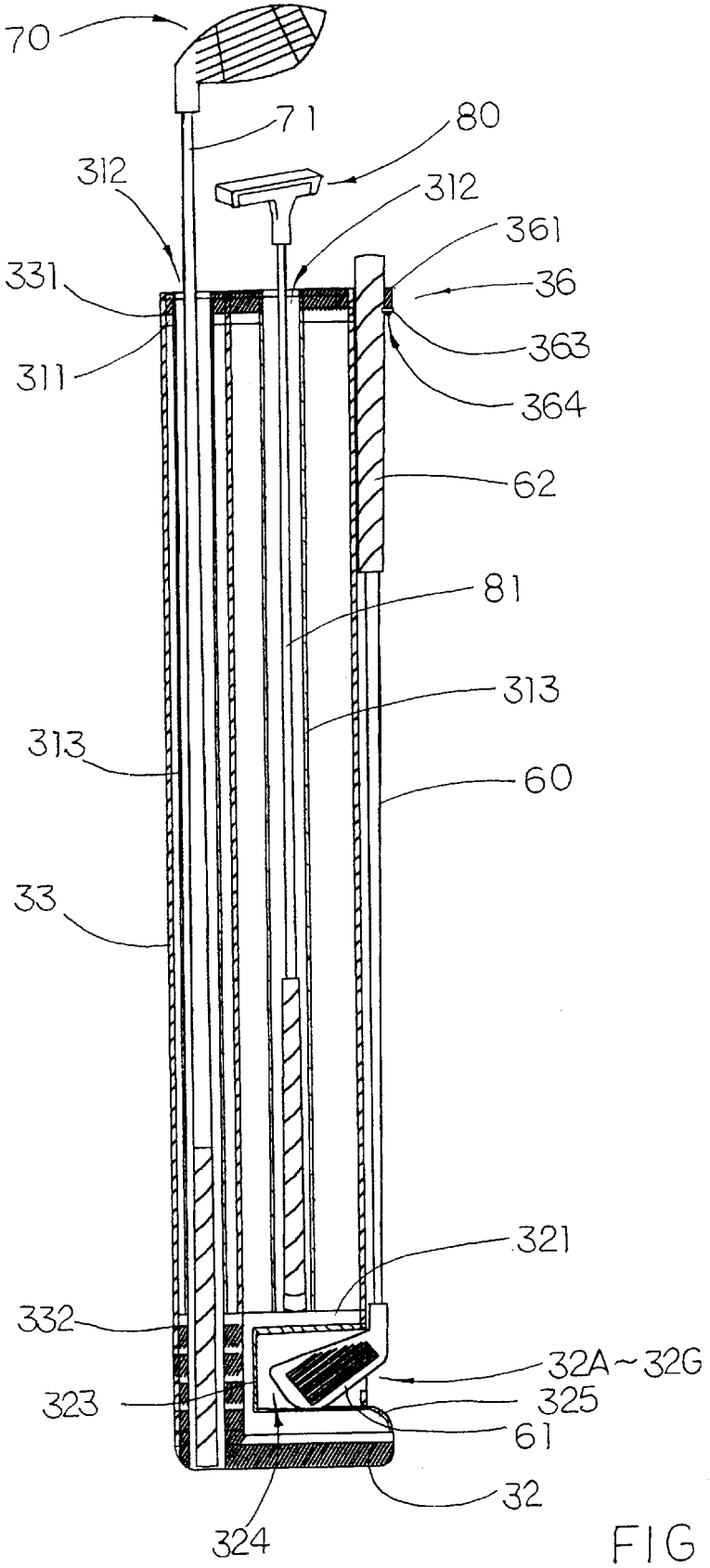
FIG. 4 is a sectional end view of the interior case of the golf bag according to the above preferred embodiment of the present invention.
Figure 6:
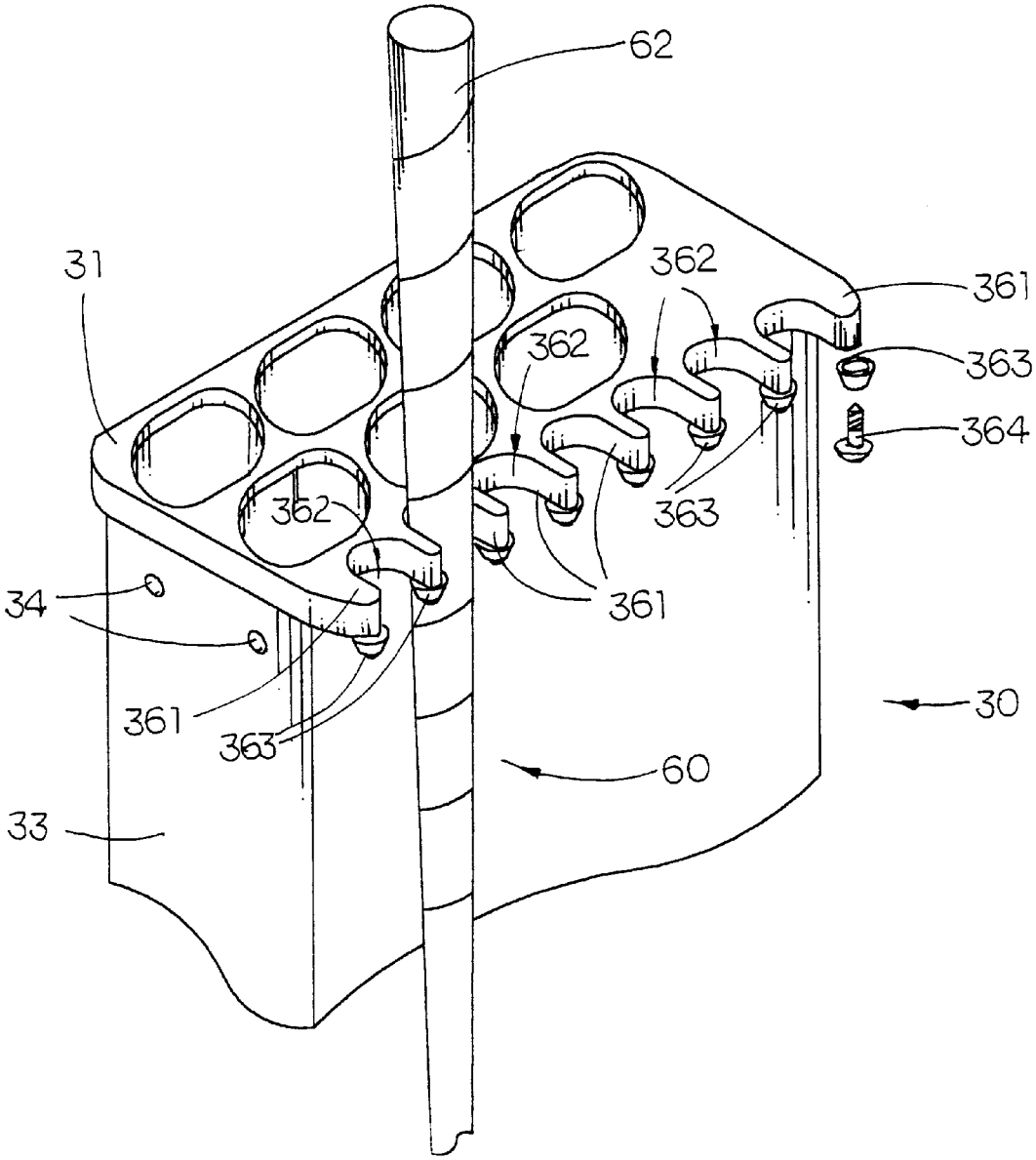
FIG. 6 is an enlarged view illustrating the top panel and the holders of the golf bag according to the above preferred embodiment of the present invention.

Referring to FIGS. 3, 4 and 6, the interior case 30 comprises a top panel 31, a base case 32 and a tubular supporting shell 33 affixed between the base case 32 and the top panel 31 to form a rectangular case. As shown in FIG. 4, the top panel 31 has a bottom connecting end 311 inserted into a top end 331 of the supporting shell 33, wherein a plurality of rivets 34 are used to rigidly affix the bottom connecting end 311 of the top panel 31 with the top end 331 of the supporting shell 33. Similarly, the base case 32 has a top connecting end 321 inserted into a bottom end 332 of the supporting shell 33, wherein a plurality of rivets 35 are used to rigidly affix the top connecting end 321 of the base case 32 with the bottom end 332 of the supporting shell 33.

Figure 5:
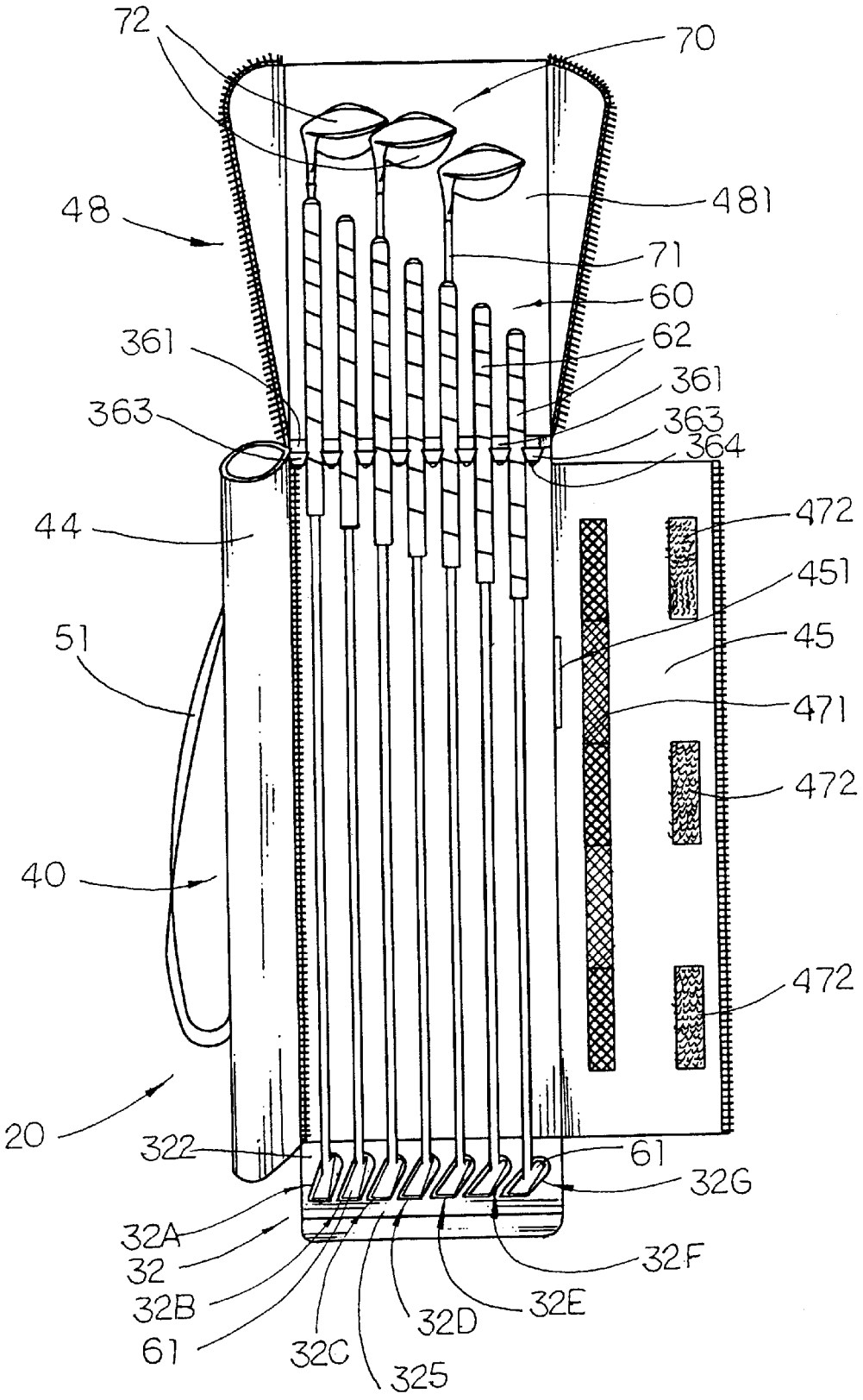
FIG. 5 is a front view of the golf bag according to the above preferred embodiment of the present invention.

As shown in FIGS. 3 and 4, a front side 322 of the base case 32 provides seven inclined slots 32*a*, 32*b*, 32*c*, 32*d*, 32*e*, 32*f*, 32*g* aligned side by side in predetermined angles of 20°, 24°, 28°, 32°, 36°, 40°, 44° respectively. In other words, the inclined angles of the seven inclined slots 32*a* to 32*g* are respectively equal to the inclined angles of the seven club heads 61 of the seven irons 60. Each of the inclined slots 32*a* to 32*g* has installed a housing 323 extended inwardly inside the base case 32 to form an individual and isolated head cavity 324, wherein the width of each head cavity 324 must be slightly larger than the thickness of each iron head 61. Therefore, the club heads 61 of the seven irons 60 are adapted to respectively insert into the corresponding head cavities 324 through the inclined slots 32*a* to 32*g*, as shown in FIGS. 4 and 5. A bottom edge 325 is outwardly protruded from the front side 322 for preventing the club heads 61 from directly contacting with the ground while aligning with the corresponding inclined slots 32*a* to 32*g*.

As shown in FIGS. 3 to 6, the top panel 31 has a plurality of openings 312 aligned thereon for respectively inserting the shafts 71, 81 of wood clubs 70 and putter 80 therethrough. In order to better guide the shafts 71, 81 inserting into the supporting shell 33, a plurality of guiding tubes 313 are mounted inside the supporting shell 33, wherein the guiding tubes 313 are vertically extended from the openings 312 to the base case 32 respectively.

As shown in FIGS. 3, 4 and 6, a plurality of holders 36 are provided on an upper portion of a front side of the interior case 30 and respectively aligned right above the slots 32*a* to 32*g* of the base case 32. Each of the holders 36 comprises a holding arm 361 protruded from a front side of the top panel 31. According to the preferred embodiment of the present invention, there are eight holding arms 361 internally protruded from the front side of the top panel 31 to define seven recesses 362 spacedly aligned between the holding arms 361. Each of the holders 36 further comprises a rotator 363 rotatably mounted under the respective holding arm 361 by a screw 364, wherein each of the rotators 363 has a central hole having a diameter larger than the screw 364, so that when the screw 364 is upwardly secured to the holding arm 361, the rotator 363 is held in position in a freely rotatable manner. The eight rotators 363 are preferably made of resilient material such as rubber, so that an upper grip 62 of the iron club 60, which club head 61 is received in the corresponding head cavity 324 of the inclined slot 32*a* to 32*g*, can be forced to enter the corresponding recess 362 by pressing against the two rotators that are 363 mounted on the two holding arms 361 to define the recess 362. Once the grip 62 enters the corresponding recess 362, the two neighboring rotators 363 will secure the respective iron 60 in position unless the golf player pulls the grip 62 outwardly from the recess 362.

It should be noted that other holders such as the C-shape clips can also be used as the holders 36 of the present invention.

As shown in FIGS. 2 and 5, the exterior cover bag 40 comprises a tubular bag body 41 fittedly enclosing around the supporting shell 33, a plurality of storage bags 42, 43 attached at a rear surface of the tubular bag body 41, and two front covers 44, 45 respectively affixed to two vertical sides of a front surface of the bag body 41, so that the two front covers 44, 45 can be connected by a zipper 46 to cover the irons 60 for protection during travelling. As shown in FIG. 5, when the golf bag 20 is in used, the player may open the two front covers 44, 45 by disconnecting the zipper 46. An inner side of an interior surface of each of the front covers 44, 45 is sewed with an elongated loop fastener 471 while an outer side of the front cover 44, 45 is sewed with several hoop fasteners 472, as shown in the right front cover 45 in FIG. 5, so that the player may attach the hoop fasteners 472 with the loop fastener 471 so as to fold up the front covers 44, 45, such as the left front cover 44 as shown in FIG. 5.

The exterior cover bag 40 further comprises a head cover 48 attached on top of the bag body 41 for protecting the wood heads 72 during travelling. The head cover 48 comprises a U-shaped back cover 481 which bottom end is connected to a top end of the bag body 41 by a zipper 482. A top and front cover 483, (as shown in FIG. 2) is connected with the back cover 481 along its two front sides by a pair of zippers 484. When the golf bag 20 is in used, the player may select to detach the whole head cover 48 or simply detached the top and front cover 483 from the back cover 481.

The means 50 for carrying the golf bag 20 comprises a shoulder strap 51 affixed to an end side of the bag body 41 for shouldering. A hand carry strap 52 may also be affixed to the end side of the bag body 41 for hand carrying.

Moreover, as shown in FIG. 2, each of the two front covers 44, 45 further has a side slot 441, 451 provided thereon, so that a fastening belt of a golf trolley or golf cart can pass therethrough to tight up the golf bag 20 of the present invention.

As shown in FIGS. 4 and 5, the seven irons 60 of a whole set of golf clubs are orderly mounted on the front surface of the golf bag 20 by inserting their club heads into the receiving cavities 324 of the seven inclined slots 32*a* to 32*g* while their grips 62 are clipped by the holders 36. Thereby, the major weight of all the club heads 61 of the irons 60 are loaded at bottom of the golf bag 20. However, the woods 70 of the set of the golf clubs are orderly placed in position by inserting their shafts 71 into the guiding tubes 313 through the openings 312 so that the club heads 72 of the woods 70 are positioned on top of the golf bag 20. Accordingly, the weight of the whole set of golf clubs stored in the golf bag 20 is balanced for steady shouldering and preventing unexpected turning over of the golf bag 20.

In view of above, the golf bag 20 of the present invention can substantially achieve the following advantages:

1. It not only enables the golf clubs stored therein being organized in weight balancing manner in order to facilitate travel carrying, but also prevents the golf clubs from impacting with each other when any particular golf club is placed in position or taken out.

2. All the club heads of the irons are positioned at bottom of the golf bag while the club heads of the woods are extended upwards, so that the total weight of all the golf clubs is balanced to prevent top-heavy condition of the golf bag.

3. Each club head of each iron is stored in an individual and isolated cavity to avoid impacting with each other during travelling.

4. It enables the golf player to smoothly and precisely take out or place in any golf club without impacting with others.

5. It enables the golf player to organize his or her golf clubs orderly, so that he or she can select the desired golf club easily and rapidly.

6. It can flatly lay in the trunk while travelling.

What is claimed is:

1. A golf bag, comprising:

an interior case which comprises a base case which has a front side providing at least seven inclined slots aligned side by side in predetermined angles of 20°, 24°, 28°, 32°, 36°, 40°, 44° respectively, wherein each of said inclined slots extends inwardly to form an individual and isolated head cavity for receiving a club head of an iron club through said respective inclined slot, a top panel having a plurality of openings provided thereon, a tubular supporting shell affixed between said base case and said top panel to form a case, and a plurality of holders which are provided on an upper portion of a front side of said case, wherein each of said holders is aligned right above one of said inclined slot of said base case for firmly securing an upper grip of said iron club while said club head thereof is received in said corresponding head cavity;

an exterior cover bag for enclosing said interior case; and means for carrying said golf bag.

2. A golf bag, as recited in claim 1, further comprising a plurality of guiding tubes mounted inside said supporting shell, wherein said guiding tubes are vertically extended from said openings to said base case respectively.

3. A golf bag, as recited in claim 1, wherein each of said holders comprises a holding arm protruded from a front side of said top panel to define a recess between every two of said holding arms, and a rotator rotatably mounted under said respective holding arm, wherein each of said rotators is made of resilient material and a distance between every two of said rotators is slightly smaller than a diameter of said upper grip of said iron club.

4. A golf bag, as recited in claim 2, wherein each of said holders comprises a holding arm protruded from a front side of said top panel to define a recess between every two of said holding arms, and a rotator rotatably mounted under said respective holding arm, wherein each of said rotators is made of resilient material and a distance between every two of said rotators is slightly smaller than a diameter of said upper grip of said iron club.

5. A golf bag, as recited in claim 3, wherein each of said rotators has a central hole having a diameter larger than that of a screw which is upwardly secured to said holding arm through said central hole of said rotator.

6. A golf bag, as recited in claim 4, wherein each of said rotators has a central hole having a diameter larger than that of a screw which is upwardly secured to said holding arm through said central hole of said rotator.

7. A golf bag, as recited in claim 5, wherein a bottom edge is outwardly protruded from said front side of said base case.

8. A golf bag, as recited in claim 6, wherein a bottom edge is outwardly protruded from said front side of said base case.

9. A golf bag, as recited in claim 1, wherein said top panel has a bottom connecting end inserted into a top end of said supporting shell, wherein a plurality of rivets are used to rigidly affix said bottom connecting end of said top panel with said top end of said supporting shell, and that said base case has a top connecting end inserted into a bottom end of said supporting shell, wherein a plurality of rivets are used to rigidly affix said top connecting end of said base case with said bottom end of said supporting shell.

10. A golf bag, as recited in claim 2, wherein said top panel has a bottom connecting end inserted into a top end of said supporting shell, wherein a plurality of rivets are used to rigidly affix said bottom connecting end of said top panel with said top end of said supporting shell, and that said base case has a top connecting end inserted into a bottom end of said supporting shell, wherein a plurality of rivets are used to rigidly affix said top connecting end of said base case with said bottom end of said supporting shell.

11. A golf bag, as recited in claim 4, wherein said top panel has a bottom connecting end inserted into a top end of said supporting shell, wherein a plurality of rivets are used to rigidly affix said bottom connecting end of said top panel with said top end of said supporting shell, and that said base case has a top connecting end inserted into a bottom end of said supporting shell, wherein a plurality of rivets are used to rigidly affix said top connecting end of said base case with said bottom end of said supporting shell.

12. A golf bag, as recited in claim 6, wherein said top panel has a bottom connecting end inserted into a top end of said supporting shell, wherein a plurality of rivets are used to rigidly affix said bottom connecting end of said top panel with said top end of said supporting shell, and that said base case has a top connecting end inserted into a bottom end of said supporting shell, wherein a plurality of rivets are used to rigidly affix said top connecting end of said base case with said bottom end of said supporting shell.

13. A golf bag, as recited in claim 8, wherein said top panel has a bottom connecting end inserted into a top end of said supporting shell, wherein a plurality of rivets are used to rigidly affix said bottom connecting end of said top panel with said top end of said supporting shell, and that said base case has a top connecting end inserted into a bottom end of said supporting shell, wherein a plurality of rivets are used to rigidly affix said top connecting end of said base case with said bottom end of said supporting shell.

14. A golf bag, as recited in claim 1, wherein said exterior cover bag comprises a tubular bag body fittedly enclosing around said supporting shell, a plurality of storage bags attached at a rear surface of said tubular bag body, and a pair of front covers respectively affixed to two vertical sides of a front surface of said bag body so that said pair of front covers are able to be connected by a zipper.

15. A golf bag, as recited in claim 14, wherein an inner side of an interior surface of each of said front covers is sewed with an elongated loop fastener while an outer side of said interior surface of each of said front covers is sewed with at least a hoop fastener, so that said pair of front covers are able to respectively fold up by attaching said hoop fastener with said loop fastener.

16. A golf bag, as recited in claim 15, wherein said exterior cover bag further comprises a head cover attached on top of said bag body, said head cover comprising a U-shaped back cover which bottom end is connected to a top end of said bag body by a second zipper, and a top and front cover which is connected with said back cover along two front sides thereof by a pair of zippers.

17. A golf bag, as recited in claim 12, wherein said exterior cover bag comprises a tubular bag body fittedly enclosing around said supporting shell, a plurality of storage bags attached at a rear surface of said tubular bag body, and a pair of front covers respectively affixed to two vertical sides of a front surface of said bag body so that said pair of front covers are able to be connected by a zipper, wherein an inner side of an interior surface of each of said front covers is sewed with an elongated loop fastener while an outer side of said interior surface of each of said front covers is sewed with at least a hoop fastener, so that said pair of front covers are able to respectively fold up by attaching said hoop fastener with said loop fastener, wherein said exterior cover bag further comprises a head cover attached on top of said bag body, said head cover comprising a U-shaped back cover which bottom end is connected to a top end of said bag body by a second zipper, and a top and front cover which is connected with said back cover along two front sides thereof by a pair of zippers, wherein said means for carrying said golf bag comprises a shoulder strap affixed to an end side of said bag body for shouldering and a hand carry strap affixed to said end side of said bag body for hand carrying.

18. A golf bag, as recited in claim 13, wherein said exterior cover bag comprises a tubular bag body fittedly enclosing around said supporting shell, a plurality of storage bags attached at a rear surface of said tubular bag body, and a pair of front covers respectively affixed to two vertical sides of a front surface of said bag body so that said pair of front covers are able to be connected by a zipper, wherein an inner side of an interior surface of each of said front covers is sewed with an elongated loop fastener while an outer side of said interior surface of each of said front covers is sewed with at least a hoop fastener, so that said pair of front covers are able to respectively fold up by attaching said hoop fastener with said loop fastener, wherein said exterior cover bag further comprises a head cover attached on top of said bag body, said head cover comprising a U-shaped back cover which bottom end is connected to a top end of said bag body by a second zipper, and a top and front cover which is connected with said back cover along two front sides thereof by a pair of zippers, wherein said means for carrying said golf bag comprises a shoulder strap affixed to an end side of said bag body for shouldering and a hand carry strap affixed to said end side of said bag body for hand carrying.

* * * * *